US005369922A

United States Patent [19]

Hansen

[11] Patent Number: 5,369,922

[45] Date of Patent: Dec. 6, 1994

[54] WINDOW FRAME ASSEMBLY

[75] Inventor: Helge Hansen, Greve Strand, Denmark

[73] Assignee: Tehrmoform A/S, Greve Strand, Denmark

[21] Appl. No.: 233,725

[22] Filed: Apr. 26, 1994

Related U.S. Application Data

[63] Continuation of Ser. No. 768,526, Oct. 3, 1991, abandoned.

[30] Foreign Application Priority Data

Apr. 6, 1989 [DK] Denmark ..... 1657/59

[51] Int. Cl.[5] ..... E06B 1/04

[52] U.S. Cl. ..... 52/204.54; 52/656.2; 52/775

[58] Field of Search ..... 52/204.53, 204.54, 208, 52/211, 212, 213, 204.5, 656.2, 656.5, 656.7, 776, 780, 775, 475

[56] References Cited

U.S. PATENT DOCUMENTS

| | | | |
|---|---|---|---|
| 2,853,161 | 9/1958 | Mascari . | |
| 3,455,080 | 7/1969 | Meadows | 52/775 X |
| 3,769,769 | 11/1973 | Kohl | 52/212 |
| 3,903,669 | 9/1975 | Pease, Jr. et al. . | |
| 3,975,881 | 8/1976 | Ninowski, Jr. | 52/775 |
| 4,280,309 | 7/1981 | Huelsekopf . | |
| 4,407,100 | 10/1983 | Huelsekopf . | |
| 4,787,184 | 11/1988 | Boidron . | |
| 5,157,885 | 10/1992 | Wertitsch et al. | 52/656.2 |

FOREIGN PATENT DOCUMENTS

| | | | |
|---|---|---|---|
| 2154931 | of 0000 | France . | |
| 2621643 | 4/1989 | France | 52/204.53 |
| 2351584 | 4/1974 | Germany | 52/212 |
| 2334802 | 1/1975 | Germany | 52/775 |
| 2614803 | 10/1977 | Germany | 52/775 |

*Primary Examiner*—Lanna Mai

*Attorney, Agent, or Firm*—Ostrolenk, Faber, Gerb & Soffen

[57] ABSTRACT

A window for insertion into an opening in a wall comprising a first frame which is adapted to abut against the outer face of the wall, a frame member provided with a rebate for a window pane and a second frame with a flange adapted to abut against the inner face of the wall. The frame member is integral with the first frame and adapted to cover the core of the wall, and includes a plurality of pairs of ribs. The ribs of each pair are connected by a strip to form an elongated opening therebetween. The second frame includes a toothed connection device consisting of tongues provided with a toothing and arranged in the longitudinal direction of the frame, the insertion of the window comprising clipping together the two frames from each side of the wall. In order to make it possible to manufacture the window frames as single pieces by injection molding, and at the same time to obtain a strong resistance to burglary, the tongues are divided into a number of spaced tongues on the second frame, the connection device on the first frame comprising correspondingly spaced openings, and the toothing is arranged on the narrow sides of the tongues to cooperate with a toothing arranged on ribs on the frame member running transverse to the frame member.

5 Claims, 3 Drawing Sheets

WINDOW FRAME ASSEMBLY

This is a continuation of U.S. patent application Ser. No. 07/768,526, filed on Oct. 3, 1991, now abandoned.

BACKGROUND OF THE INVENTION

1. Field of the Invention

The present invention relates to a window for insertion into walls of various thicknesses and including connection means which cannot be easily detected from the outside, providing good resistance to burglary.

2. Description of the Related Art

Extruded windows are known, for example, in U.S. Pat. No. 4,407,100. The frames are constructed from extruded profile sections being cut at the ends at an angle of 45°, before being assembled by gluing, to form closed frames of the desired size. By assembling the window frames at the corners, it is possible to produce window frames of any size. However, the cutting and assembly add to the number of time consuming steps needed in production, and the assembly must be made carefully in order to avoid weakness in the frame. The design of the profiles of these known windows comprises various hollow spaces and cannot be manufactured by methods other than extrusion molding from plastic and aluminum. The windows made from extruded profiles, however, may be made with a good resistance against burglary, owing to the hidden design of the connection means.

French Patent No. 2,154,931 discloses a window including burglary resistant means. The toothed connection means comprises hooks gripping into openings in the frame member of the first frame. On each of the sides of the window a few hooks and corresponding openings are used for holding together the two frames after insertion. A disadvantage of this known window type is that the placement of the hooks is easily detectable from the outside and can be overcome by a burglar, whereby the window is not effectively secured against burglary. Furthermore, there is only one position in which the hooks are locked, whereby the window is intolerant to variations in the thickness of the wall in which it is to be inserted.

SUMMARY OF THE INVENTION

The object of the present invention is to provide a window in which the connection means are of a type which are highly resistant to reopening and in which the connection means may be pressed together and locked in a number of positions in order to make the window tolerant to variations in wall thicknesses.

Another object of the present invention is to provide a window of the above-mentioned type, in which the frames are adapted to be manufactured as single pieces, and in which a resistance against burglary is obtained.

Due to the shaping of the connection means as tongues, on the narrow sides of which a toothing is arranged, and by pressing the tongues into the interspace between oppositely arranged countertoothings, a powerful locking effect is obtained which is nearly impossible to reopen. The resistance to bending of the tongues in the direction of their wide dimension strongly contributes to this. As the tongues are inserted in pockets on the outer face of the frame member, the placement of the tongues cannot be detected from the outside, whereby burglary by drilling is hindered. The ribs on which the countertoothing is arranged act as reinforcing members for the frame means, making the first frame very strong and stable. By arranging the toothing on the narrow sides of the tongues, any difficulties in removing the frames from the molds after molding is eliminated, as this type of toothing may be produced by means of movable elements and simple design of the molds.

In accordance with a preferred embodiment according to the invention, the pockets are shaped as elongate openings in a web along the outer edge of a rebate for a second window pane, the ribs standing free between the flange of the first frame and the web. With this embodiment, the tool for the manufacture of the countertoothing may be removed through the free opening between the ribs and the flange and the web.

Preferably, the tongues are arranged approximately in the middle between the flange of the second frame and a sealing lip resting against the second window pane. This arrangement enables the second frame to compensate for variations in the thickness of the wall, as the thin tongues do not prevent the frame from being positioned at a slight angle with the plane of the window.

BRIEF DESCRIPTION OF THE DRAWINGS

The invention will be more clearly understood with reference to the following detailed specification read in conjunction with the drawings, wherein.

DETAILED DESCRIPTION OF THE PREFERRED EMBODIMENTS

Figure 1:
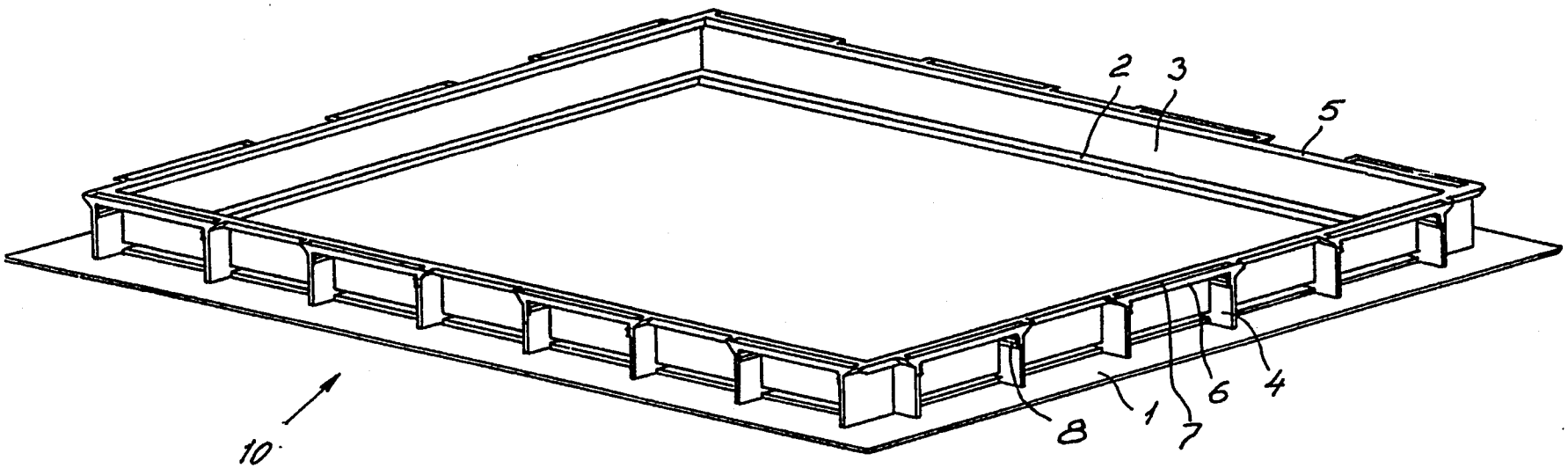
FIG. 1 is a perspective view of the first frame of the window in accordance with the present invention.
Figure 2:
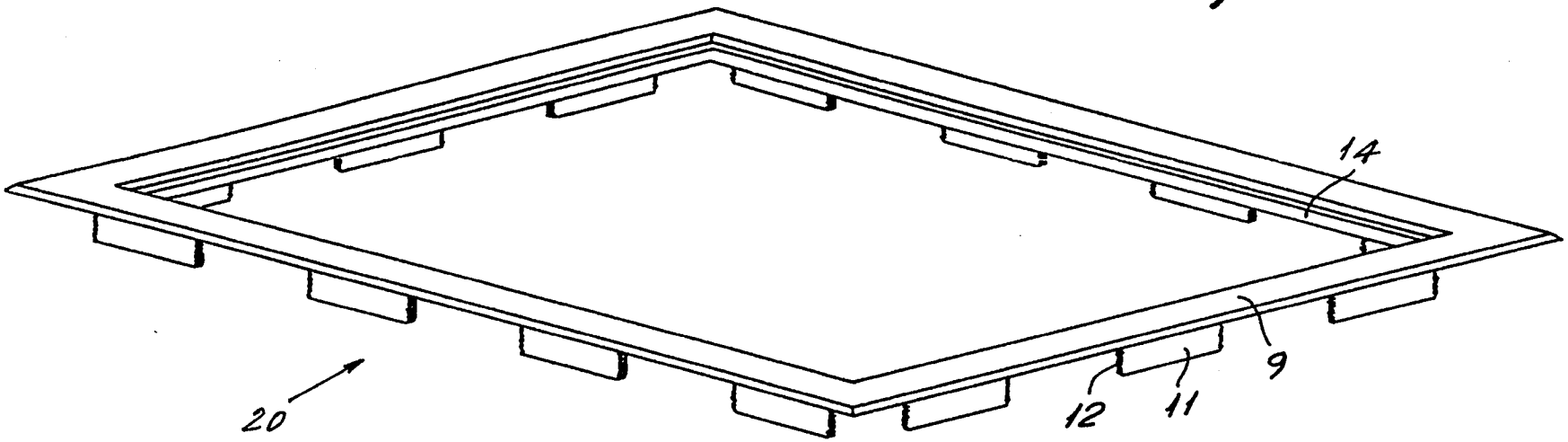
FIG. 2 is a perspective view of the second frame of the window in accordance with the present invention.

The window according to the present invention comprises a first and second frame shown in FIG. 1 and FIG. 2, respectively. The first frame 10 has a flange 1, which is adapted to abut against one side of a wall 13, for example, the outer exterior face, when the frame is inserted in an opening in the wall. The frame 10 has a rebate 2, onto which a pane 15 of acrylic material or another transparent material may be fastened by gluing. Perpendicular to the flange 1, there is provided a frame member 3, which member covers the core of the wall when the window is mounted. The frame member 3 is stiffened with respect to the flange 1 by means of ribs 4, which further form part of the connecting means by which the first and second frames 10, 20 are interconnected. The innermost face of the frame member 3 forms a second rebate 5, onto which a second window pane 16 may be fastened by gluing, so that the first frame may form a double glazed unit. In the longitudinal direction of the rebate 5, the ribs 4 are connected in pairs by means of a strip 6, in such a way that between the ribs 4, rebate 5, and the strip 6 an elongate opening 7 is formed. A toothing or toothed portion 8 is arranged on the faces of the ribs interconnected with the strip 6, with the teeth running transversely to the frame member 3.

The second frame 20 shown in FIG. 2 comprises a flange 9 adapted to abut against the inner or interior face of the wall and a sealing lip 14 which, after insertion of the window into the wall, abuts against the second window pane or against the rebate 5. In a special embodiment which is adapted to be used in connection with a single-glazed window, the sealing lip 14 may have such a width that the edge of the sealing lip rests on the first pane. Approximately at the middle between the sealing lip 14 and the outer edge of the flange 9, a number of flat tongues 11 are arranged, each of which are provided with a toothing 12 on their narrow sides edges. The distance between the tongues 11 and the width of the tongues is adjusted to exactly fit in the elongate openings 7 when the first and the second frames are pressed together. Thereby, it is possible to clip the two frames together as illustrated in FIGS. 3A, 3B and 3C.

Figure 3A:
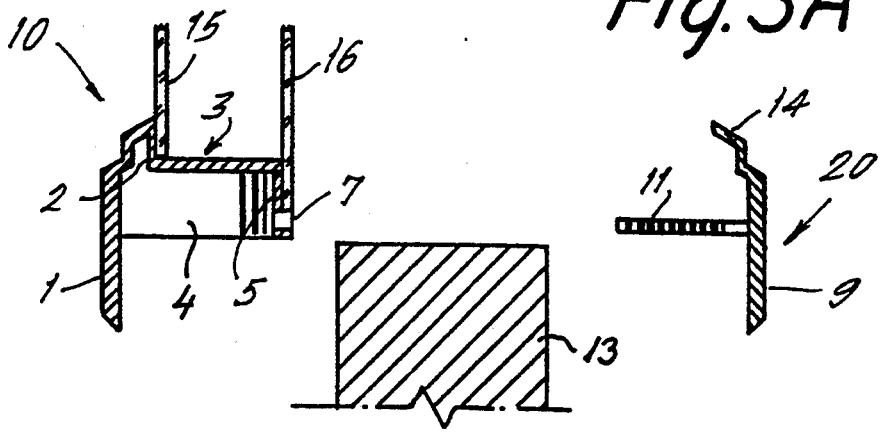
FIGS. 3A, 3B and 3C show three stages of assembly of the two frames during insertion of the window into the wall.
Figure 3B:
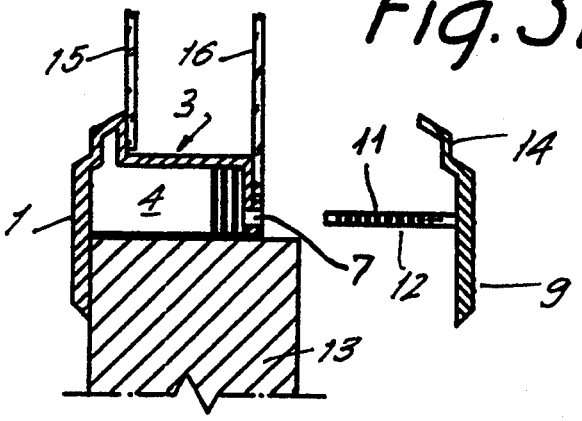
Figure 3C:
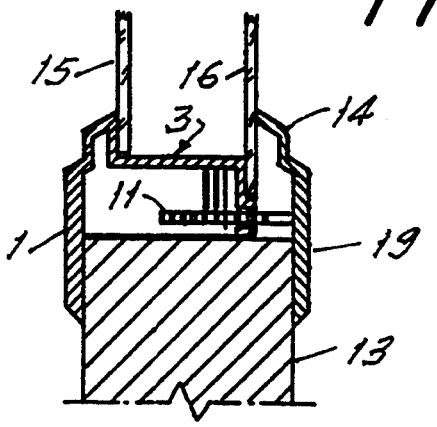

The insertion of the window into the wall is accomplished as shown in FIGS. 3A, 3B and 3C. The first frame 10 with the two panes 15, 16 is inserted in an opening in a wall 13 from one side, the opening having such dimensions that the ribs 4 fit into the opening with a small interspace as shown in FIG. 3B. Thereafter, the other frame 20 is inserted from the opposite side in such a way that the tongues 11 are introduced in the elongate openings 7. Thereupon, the two frames 10, 20 are pressed together as shown in FIG. 3C, whereby the two flanges 1 and 9 come into bearing engagement with the inner and outer faces of the wall 13, respectively. The toothings 8 and 12, shaped like saw teeth, come into engagement and act as barbs preventing the separation of the frames. The interlocking of the two frames is completely hidden and cannot be manipulated from the outside due to the extension of the tongues in the elongate openings 7.

Although the present invention has been described in relation to particular embodiments thereof, many other variations and modifications and other uses will become apparent to those skilled in the art. It is preferred, therefore, that the present invention be limited not by the specific disclosure herein, but only by the appended claims.

I claim:

1. A window frame assembly, comprising:

a first frame;

a frame member extending from and perpendicular to said first frame, said frame member including at least one rebate for receiving a window pane;

a second frame; and connecting means for connecting said first and second frames together, said connecting means comprising a plurality of pairs of ribs disposed on a surface of said frame member and perpendicular to both said frame member and said first frame, a strip disposed between the ribs of each of said pairs and spaced from said frame member to form an elongate opening therebetween, said elongate opening being bounded on four sides by said pair of ribs, said frame member and said strip and a plurality of flat tongues having side edges disposed on said second frame, each of said tongues being capable of being received in each said opening to clasp said first and second frames together, each of the plurality of flat tongues and ribs being provided with teeth, said teeth of said ribs extending in a direction transverse to said frame member, said teeth of said flat tongues being located on said side edges and engaging said teeth of said ribs when each of said tongues is inserted into each said opening to lock said first and second frames together;

wherein said first frame, said frame member, said plurality of pairs of ribs, and each said strip are formed in a single integral piece.

2. The window frame assembly of claim 1, wherein said first frame is adapted to abut the outside face of the wall and said second frame includes a flange which is adapted to abut the inside face of the wall when said first and second frames are connected together.

3. The window frame assembly of claim 1, wherein said frame member includes two rebates.

4. The window frame assembly of claim 3, wherein said second frame includes a sealing lip.

5. The window frame assembly of claim 4, wherein said second frame including a flange, said tongues extend transversely from said second frame and are arranged between said sealing lip and said flange.

* * * * *